United States Patent [19]

Meenan

[11] 4,273,527

[45] Jun. 16, 1981

[54] MULTIPLE FUEL BURNING SYSTEM FOR FURNACES OR THE LIKE

[76] Inventor: Cyril F. Meenan, 7349 Ridgeway, Skokie, Ill. 60076

[21] Appl. No.: 72,103

[22] Filed: Sep. 4, 1979

[51] Int. Cl.[3] ..... F27D 17/00

[52] U.S. Cl. ..... 431/177; 431/178; 431/352; 110/262

[58] Field of Search ..... 431/175–181, 431/285, 278, 351, 352; 110/104 B, 261, 262

[56] References Cited

U.S. PATENT DOCUMENTS 2,883,948 4/1959 Seidl ..... 431/176

FOREIGN PATENT DOCUMENTS 301851 12/1928 United Kingdom ..... 110/262

*Primary Examiner*—James C. Yeung

*Attorney, Agent, or Firm*—Mason, Kolehmainen, Rathburn & Wyss

[57] ABSTRACT

A multiple fuel burning system that may be employed in conjunction with a furnace includes a first annular tubular conduit connected to a source of pressurized fluid and a second annular conduit concentric with the first annular tubular conduit and coupled to a source of pressurized fuel. A third annular tubular conduit is also included that is concentric with the first and second tubular conduits but of a lesser diameter so as to be within the first and second annular tubular conduits. The third annular tubular conduit is connected to a source of heat retaining liquid such as water or the like. The first, second and third tubular conduits define an elongated combustion chamber with three nozzles mounted at one end. Two of the three nozzles are connected to a source of combustible fuel such as fuel oil. The third nozzle may be connected to a source of pulverized combustible fuel.

13 Claims, 2 Drawing Figures

MULTIPLE FUEL BURNING SYSTEM FOR FURNACES OR THE LIKE

BACKGROUND OF THE INVENTION

A. Field of the Invention

The present invention relates to a new and improved multiple fuel burning system that may be employed with a furnace or the like.

B. Description of the Prior Art

As sources of energy become scarce it is important to conserve energy through the use of the most efficient energy consuming devices possible. In meeting this need, it is helpful if the energy consuming devices use many different forms of energy. For example, alternative sources of energy such as garbage, pulverized materials and the like if used, will reduce the demand for scarcer fuels such as gasoline and oil. An example of a device that may be employed to provide more efficient use of fuel is illustrated in U.S. Pat. No. 3,174,530 and is incorporated by reference herein.

To insure more efficient use of fuel, it is important in fuel burning devices that a sufficient and proper mix of air and fuel is provided in the combustion chamber. In addition, the proper mixture of air and fuel should be insured throughout the length of the combustion chamber; particularly, if low combustion point fuels are used such as pulverized garbage, tires and the like.

SUMMARY OF THE INVENTION

An object of the present invention is to provide a new and improved multiple fuel burning system that may be employed with furnaces and the like.

Another object of the present invention is to provide a new and improved multiple fuel burning system that includes sources of air and gas throughout the length of a combustion chamber to insure complete combustion of the fuel.

A further object of the present invention is to provide a new and improved fuel burning system that burns fuel oil, gas and pulverized fuel such as rubber tires, garbage and the like.

The present invention is directed to a new and improved multi-fuel burning system that may be employed with a furnace or the like. The system of the present invention includes first and second concentric annular tubular conduits. The first conduit is connected to a source of pressurized fluid such as air and the second conduit is connected to a source of pressurized fuel such as gas.

Concentric with the first and second tubular conduits and of a lesser diameter is a third annular tubular conduit that is connected to a source of heat retaining fluid such as water or the like. The first and second conduits include a series of jets directed inwardly toward a combustion chamber defined by the first, second and third tubular conduits.

In addition, three nozzles are mounted within the combustion chamber at one end thereof. The first and second nozzles are coupled to a source of fuel oil and the third nozzle is coupled to a source of pulverized fuel.

BRIEF DESCRIPTION OF THE DRAWING

The above and other objects and advantages and novel features of the present invention will become apparent from the following detailed description of the preferred embodiment of the invention illustrated in the accompanying drawing wherein.

DESCRIPTION OF THE PREFERRED EMBODIMENT

Figure 1:
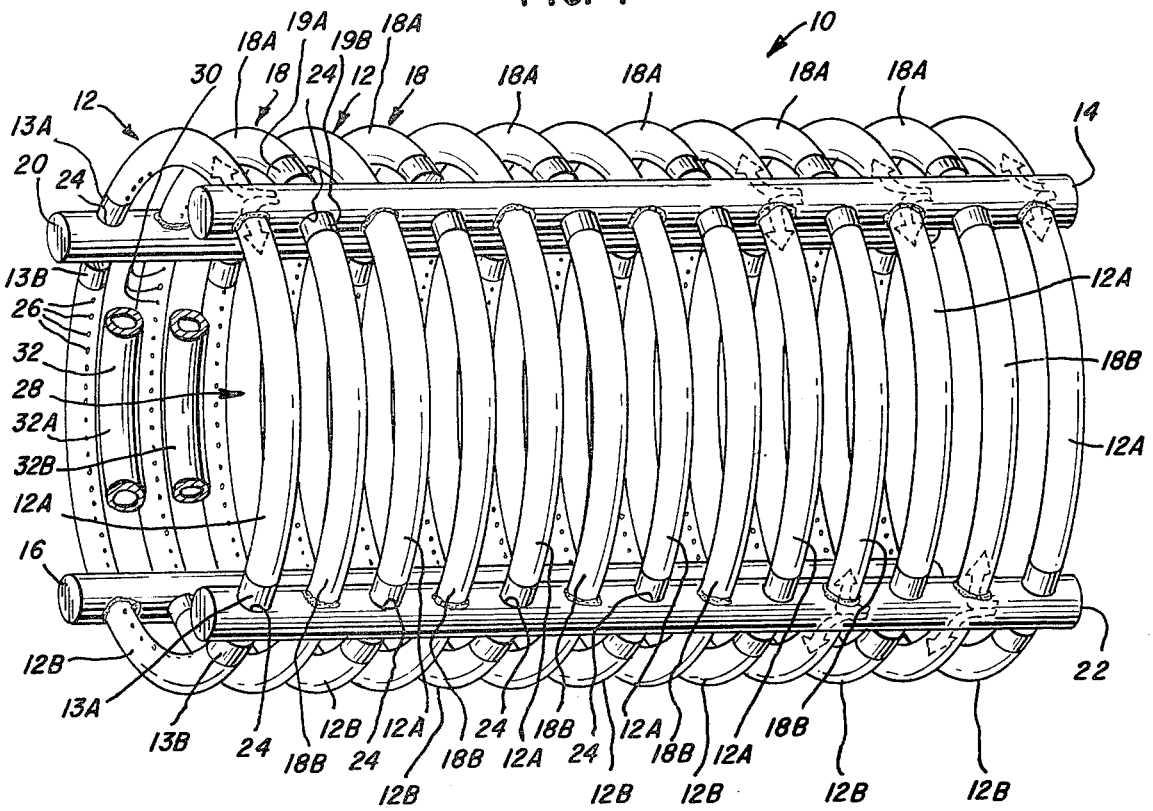
FIG. 1 is a perspective view of a fuel burning system constructed in accordance with the principles of the present invention.

Referring now to the drawing, there is illustrated and disclosed a combination gas and oil assisted pulverized fuel burning system generally designated by the reference numeral 10 that may be employed in conjunction with a high or low pressure furnace such as the type illustrated in U.S. Pat. No. 3,174,530 incorporated by reference herein. It is the intention of the system 10 to employ or use scarce resources efficiently and to this end pulverized fuel such as garbage is also intended to be burned in the system 10.

Since one source of fuel used in the system 10 is pulverized material, proper mixture of gas and air throughout the length of the system 10 is necessary to insure proper combustion. The system 10 includes a first set of annular tubular conduits 12 defined by individual conduits 12A and 12B that are in fluid communication with supply tubes 14 and 16. The supply tubes 14 and 16 are connected to a source of pressurized fluid such as an air compressor. The system 10 further includes a second set of annular tubular conduits 18 defined by individual conduits 18A and 18B that are in fluid communication with supply tubes 20 and 22 that are connected to a source of pressurized gas such as a premix burner.

Each individual conduit as 12A, 12B, 18A and 18B is in fluid communication with only one of the supply tubes 14, 16, 20 or 22. For example, as illustrated in FIG. 1, the conduits 12A of set 12 are in fluid communication with supply tube 14 and fluid flows therethrough in the direction of the arrows but the conduits 12A are terminated by caps 13A that are mounted in depressions 24 in supply tubes 20 and 22, and thus, do not intersect tubes 20 and 22. Similarly, conduits 12B are in fluid communication with supply tube 16 but are terminated by caps 13B at the supply tubes 20 and 22. Conduits 18A and 18B are similarly connected to the set 18 and conduits 18A are in communication with supply tube 20 but terminate at caps 19A at supply tubes 14 and 16. Conduits 18B are similarly capped by caps 19B.

The sets of tubular conduits 12 and 18 define a combustion chamber 28. Around the inner periphery of each conduit 12A and 12B of the set of tubular conduits 12 are a series of jet openings 26 directed inwardly to the combustion chamber 28 to allow the passage of air into the chamber 28 along the entire length thereof. Similarly, each conduit 18A and 18B of the second set of tubular conduits 18 also includes a series of jet openings 30 extending along toward the combustion chamber 28 to allow the passage of gas from the set of tubular conduits 18 into the combustion chamber 28 along the entire longitudinal length thereof.

Figure 2:
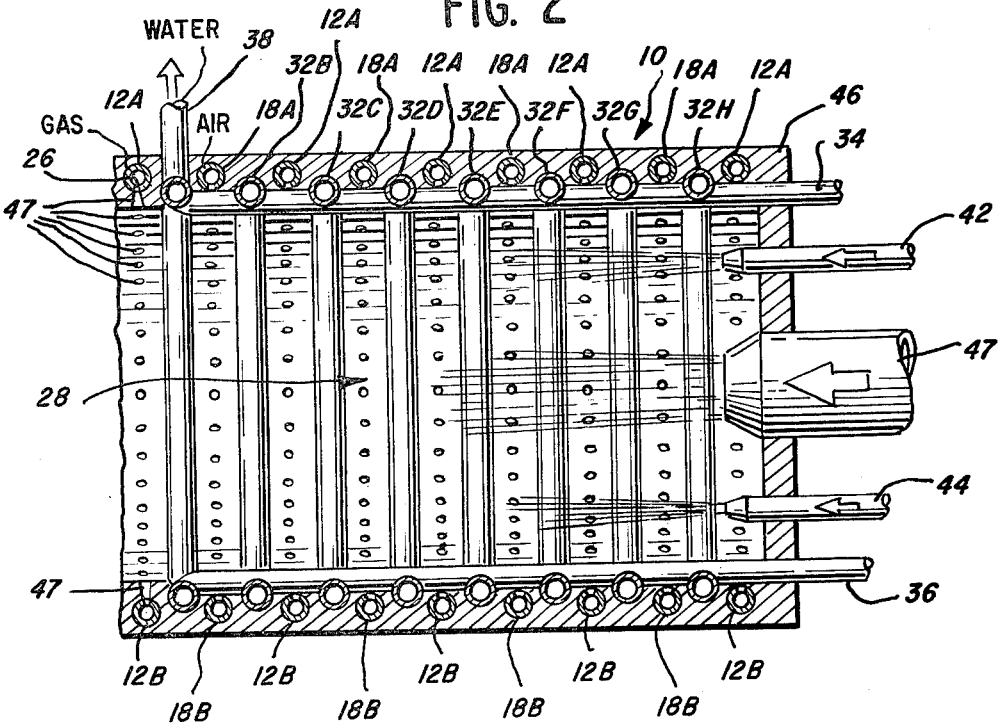
FIG. 2 is a vertical cross-sectional view of the system of the present invention mounted in refractory material.

Within the and between each tubular conduit 12A, 12B, 18A, and 18B is a third set of tubular conduits 32 that is connected to liquid supply lines 34 and 36 that, in the preferred embodiment, are in fluid communication with a source of heat retension fluid such as water. For example, the lines 34 and 36 may be connected to the outlet of a boiler of a furnace. The supply lines 34 and 36 communicate with an outlet line 38 and communicate along the lengths thereof with individual conduits 32A and 32 B of the set 32. The outlet 38 may be connected to an inlet of a boiler of a furnace or a similar device that utilizes fluid at a high temperature. As best seen in FIG. 2, the third set of annular conduits 32 although concentric with the first 12 and second 18 tubular conduits, is of a smaller diameter so as to be inside of the conduit sets 12 and 18.

As illustrated in FIG. 2, at one end of the combustion chamber 28 there are located three fuel nozzles. A first nozzle 40 is coaxial with and lies along the axis of the cylindrical combustion chamber 28. Nozzle 40 is connected to a source of pulverized fuel such as pulverized coal or garbage. At opposite sides of the nozzle 40 are additional nozzles 42 and 44 that, in the preferred embodiment, are coupled to a source of fuel oil.

The system 10, as illustrated in FIG. 2 may be mounted in a housing 46 of refractory material with the first 12 and second 18 sets of tubular conduits embedded therein with openings 47 in the housing 46 adjacent the jet openings 26 and 30. The third set of conduits 32 are mounted on the inner peripheral surface of the housing 46 and exposed to the combustion chamber 28 to insure efficient heating of the water within the conduit set 32 during operation of the system 10.

The system 10 operates by firing of the combustion chamber 28 and feeding the chamber with fuel from the nozzles 42 and 44 to create a high temperature that results in proper combustion of the pulverized fuel introduced by the nozzle 40. In addition, the combustion process is maintained throughout the length of the combustion chamber 28 by the introduction of the air by the first set of conduits 12 and gas by the second set of conduits 18 extending along the full length of the combustion chamber 28. Water or a similar heat retaining liquid is circulated through the third set of conduits 32 and is substantially elevated in temperature by the combustion and is directed through the outlet 38 to the appropriate utilization device.

Many modifications and variations of the present invention are possible in light of the above teachings. Thus, it is to be understood that, within the scope of the appended claims, the invention may be practiced other than as specifically described above.

What is claimed as new and desired to be secured by Letters Patent of the United States is:

1. A fuel burning system for a furnace or the like capable of burning multiple fuels comprising:
- a plurality of first annular tubular conduits coupled to a first supply of pressurized gas,
- a plurality of second annular tubular conduits alternately spaced between said first conduits coupled to a second supply of pressurized gas,
- a plurality of third annular tubular conduits coupled to a source of liquid to be heated,
- said first, second and third annular tubular conduits defining a combustion chamber,
- said first and second tubular conduits are concentric and said third tubular conduit is concentric with and positioned between said first and second tubular conduits,
- a first nozzle in said combustion chamber coupled to a source of a first combustible fuel,
- a second nozzle in said combustion chamber coupled to a source of a second combustible fuel, and
- a third nozzle in said combustion chamber coupled to a source of a third combustible fuel.

2. The combustion system claimed in claim 1 wherein said first and second conduits each includes a series of jet openings directed inwardly toward said combustion chamber.

3. The combustion system claimed in claim 1 wherein said first and second combustible fuels are fuel oil.

4. The combustion system claimed in claim 1 wherein said third combustible fuel is pulverized fuel.

5. A fuel burning system for a furnace or the like comprising:
- a housing of refractory material,
- said annular, tubular conduits of said first and second sets being alternately spaced and embedded in said housing,
- first and second sets of annular, tubular conduits,
- a first supply tube in communication with a source of pressurized air and said first set of conduits, said second set of conduits in communication with said first supply tube, first means for blocking flow from said first supply tube to said second set of conduits,
- a second supply tube in communication with a source of fuel and said second set of conduits, said first set of conduits in communication with said second supply tube, second means for blocking flow from said second supply tube to said second set of conduits,
- a third set of annular conduits in communication with a source of heat retaining fluid to be heated by said system,
- said annular conduits of said third set being positioned between said tubular conduits of said first and second sets,
- said first, second and third conduits defining a combustion chamber,
- first and second nozzles extending into said combustion chamber and coupled to a first source of fuel, and
- a third nozzle extending into said combustion chamber and coupled to a source of pulverized fuel.

6. The system claimed in claim 5 wherein said first and second tubular conduits each further comprises a series of jet openings directed toward said combustion chamber.

7. The system claimed in claim 5 wherein said first and second tubular conduits are concentric 8. The system claimed in claim 7 wherein said third conduit is concentric with said first and second tubular conduits and of a smaller diameter.

9. A combination gas and oil assisted pulverized fuel burning system comprising
- first and second concentric, alternately spaced annular tubular conduits,
- said first tubular conduit in fluid communication with a source of air,
- said second tubular conduit in fluid communication with a source of gaseous fuel,
- a third annular conduit concentric with and positioned between said first and second annular tubular conduits and of a smaller diameter,
- a combustion chamber defined by said first, second and third tubular conduits,
- means in said first and second conduits for directing said gaseous fuel and said air into said combustion chamber,
- first and second nozzles mounted in said combustion chamber, and coupled to a source of fuel, and
- a third nozzle mounted in said combustion chamber and coupled to a source of pulverized fuel.

10. The system set forth in claim 9 wherein said directing means comprises a series of jet openings in each of said first and second tubular conduits.

11. The system set forth in claim 9 wherein said fuel is fuel oil.

12. The system set forth in claim 9 further comprising a housing of refractory material.

13. The system set forth in claim 9 wherein said third conduit is connected to a source of water.

* * * * *